US010590709B2

(12) United States Patent
Sicilian et al.

(10) Patent No.: US 10,590,709 B2
(45) Date of Patent: Mar. 17, 2020

(54) DOWNHOLE OSCILLATION APPARATUS

(71) Applicant: REME TECHNOLOGIES, LLC, Conroe, TX (US)

(72) Inventors: Joshua Alan Sicilian, Houston, TX (US); Faraz Ali, Friendswood, TX (US); Avinash Cuddapah, Pearland, TX (US)

(73) Assignee: Reme Technologies LLC, Conroe, TX (US)

( * ) Notice: Subject to any disclaimer, the term of this patent is extended or adjusted under 35 U.S.C. 154(b) by 140 days.

(21) Appl. No.: 15/652,511

(22) Filed: Jul. 18, 2017

(65) Prior Publication Data

US 2019/0024459 A1 Jan. 24, 2019

(51) Int. Cl.
*E21B 7/24* (2006.01)
*E21B 28/00* (2006.01)
(Continued)

(52) U.S. Cl.
CPC ..... *E21B 7/24* (2013.01); *E21B 6/04* (2013.01); *E21B 21/103* (2013.01); *E21B 28/00* (2013.01);
(Continued)

(58) Field of Classification Search
CPC ..... E21B 7/24
See application file for complete search history.

(56) References Cited

U.S. PATENT DOCUMENTS 2,780,438 A 5/1952 Bielstein
2,750,154 A 6/1952 Boice
(Continued)

FOREIGN PATENT DOCUMENTS

CA 2861990 A1 8/2013
CN 105089501 A 11/2015
(Continued)

OTHER PUBLICATIONS

International Search Report for corresponding PCT/US2018/042413, dated Oct. 29, 2018, 5 pages.

*Primary Examiner* — William D Hutton, Jr.
*Assistant Examiner* — Steven A MacDonald
(74) *Attorney, Agent, or Firm* — Patterson Intellectual Property Law, PC; William E. Sekyi

(57) ABSTRACT

A downhole oscillation tool includes a Moineau-type positive displacement pulse motor and a valve assembly for use in a drill string. The pulse motor includes a rotor configured to nutate within the bore of a stator. The rotor has at least two helical lobes that extend the length of the rotor, and the stator bore defines at least three helical lobes that extend the length of the stator. The valve assembly includes a first valve plate connected to the bottom end of the rotor and abuts the second valve plate to form a sliding seal. The second valve plate is fixedly coupled to the stator and remains stationary. First valve ports extend axially through the first valve plate, and second valve ports extend axially through the second valve plate. The first valve ports and second valve ports intermittently overlap as the first valve plate slides across the second valve plate to create pulses in the drilling fluid which is pumped through the tool to power the motor and valve assembly. The tool can generate pulses of different amplitudes and different wavelengths in each rotational cycle. The tool further includes a drop ball assembly configured to activate and deactivate the tool.

13 Claims, 17 Drawing Sheets

(51) Int. Cl.

| | |
|---|---|
| ***E21B 6/04*** | (2006.01) |
| ***E21B 21/10*** | (2006.01) |
| ***E21B 34/10*** | (2006.01) |
| *E21B 7/04* | (2006.01) |
| *E21B 34/06* | (2006.01) |

(52) U.S. Cl.
CPC ..... *E21B 34/10* (2013.01); *E21B 7/04* (2013.01); *E21B 34/063* (2013.01)

(56) References Cited

U.S. PATENT DOCUMENTS

| | | | | |
|---|---|---|---|---|
| 2,963,099 | A | 12/1960 | Gianelloni, Jr. | |
| 3,594,106 | A | 7/1971 | Garrison | |
| 3,768,576 | A | 10/1973 | Martini | |
| 3,802,515 | A | 4/1974 | Flamand | |
| 4,280,524 | A * | 7/1981 | Beimgraben | E21B 4/02 137/268 |
| 4,396,071 | A | 8/1983 | Stephens | |
| 4,462,469 | A | 7/1984 | Brown | |
| 4,566,541 | A * | 1/1986 | Moussy | E21B 33/1294 166/194 |
| 4,789,032 | A * | 12/1988 | Rehm | E21B 7/068 175/256 |
| 5,009,272 | A | 4/1991 | Walter | |
| 5,421,420 | A | 6/1995 | Malone | |
| 5,679,894 | A | 10/1997 | Kruger | |
| 6,026,912 | A | 2/2000 | King | |
| 6,102,138 | A | 8/2000 | Fincher | |
| 6,279,670 | B1 * | 8/2001 | Eddison | E21B 4/02 175/107 |
| 6,540,020 | B1 | 4/2003 | Falgout, Sr. | |
| 7,086,486 | B2 | 8/2006 | Ravensbergen | |
| 7,139,219 | B2 | 11/2006 | Kollé | |
| 7,219,752 | B2 | 5/2007 | Wassell | |
| 7,251,590 | B2 | 7/2007 | Huang | |
| 8,535,028 | B2 * | 9/2013 | Groves | F01C 1/10 166/104 |
| 9,057,245 | B2 | 6/2015 | Wassell | |
| 9,359,881 | B2 | 6/2016 | DiSantis | |
| 9,540,877 | B2 | 1/2017 | Lanning | |
| 9,637,991 | B2 * | 5/2017 | Eddison | E21B 31/005 |
| 2005/0129547 | A1 | 6/2005 | Burns et al. | |
| 2005/0274525 | A1 | 12/2005 | Stevens et al. | |
| 2008/0093077 | A1 * | 4/2008 | Daccord | E21B 27/02 166/310 |
| 2009/0107723 | A1 | 4/2009 | Kusko | |
| 2011/0073374 | A1 | 3/2011 | Bunney | |
| 2011/0120772 | A1 | 5/2011 | McLoughlin | |
| 2011/0198126 | A1 | 8/2011 | Swietlik | |
| 2011/0232966 | A1 | 9/2011 | Kyllingstad | |
| 2012/0292015 | A1 | 11/2012 | Schultz | |
| 2014/0119974 | A1 | 5/2014 | Kitching | |
| 2014/0190749 | A1 * | 7/2014 | Lorenson | E21B 4/02 175/51 |
| 2015/0267534 | A1 * | 9/2015 | Gosney | E21B 7/18 175/25 |
| 2016/0273322 | A1 * | 9/2016 | Russo | E21B 34/12 |
| 2016/0281449 | A1 * | 9/2016 | Lorenson | E21B 4/02 |
| 2016/0305188 | A1 | 10/2016 | Hay | |
| 2019/0010762 | A1 * | 1/2019 | Rossing | E21B 43/126 |

FOREIGN PATENT DOCUMENTS

| | | | |
|---|---|---|---|
| WO | 9744565 | A1 | 11/1997 |
| WO | 2016108858 | A1 | 7/2016 |

* cited by examiner

DOWNHOLE OSCILLATION APPARATUS

BACKGROUND

The present disclosure relates generally to a downhole oscillation apparatus. More particularly, but not exclusively, the present disclosure pertains to a drilling apparatus and a drilling method, and to a flow pulsing method and a flow pulsing apparatus for a drill string.

In the oil and gas exploration and extraction industries, forming a wellbore conventionally involves using a drill string to bore a hole into a subsurface formation or substrate. The drill string, which generally includes a drill bit attached at a lower end of tubular members, such as drill collars, drill pipe, and optionally drilling motors and other downhole drilling tools, can extend thousands of feet or meters from the surface to the bottom of the well where the drill bit rotates to penetrate the subsurface formation. Directional wells can include vertical or near-vertical sections that extend from the surface as well as horizontal or near horizontal sections that kick off from the near vertical sections. Friction between the wellbore and the drill string, particularly near the kick off point and in the near horizontal sections of the well can reduce the axial force that the drill string applies on the bit, sometimes referred to as weight on bit. The weight on bit can be an important factor in determining the rate at which the drill bit penetrates the underground formation.

Producing oscillations or vibrations to excite the drill string can be used to reduce the friction between the drill string and the wellbore. Axial oscillations can also provide a percussive or hammer effect which can increase the drilling rate that is achievable when drilling bores through hard rock. In such drilling operations, drilling fluid, or mud, is pumped from the surface through the drill string to exit from nozzles provided on the drill bit. The flow of fluid from the nozzles assists in dislodging and clearing material from the cutting face and serves to carry the dislodged material through the drilled bore to the surface.

However, the oscillations produced by known systems can be insufficient in reducing friction in some sections of the drill string and can cause problems if applied in other sections of the drill string. Friction in the vertical sections of the well bore is generally not as great as at the kick-off point and in the near-horizontal sections. With little attenuation produced by friction, oscillations produced in the near vertical sections of the drill string and wellbore can damage or create problems for drill rig and other surface equipment. Moreover, oscillations can coincide with harmonic frequencies of the drill string (which can depend on the structure and makeup of the drill string) and constructively interfere to produce damaging harmonics.

Also, the near horizontal sections of a directional well can be very long and, in some cases, significantly longer than the vertical sections. As the drill string penetrates further in the horizontal portions of the well, exciter tools in the drill string can move further away from the high friction zones of the wellbore at the kick-off point and nearby horizontal sections. The high friction in the horizontal sections can attenuate the oscillations produced by distant exciter tools.

With the recent dramatic increase in unconventional shale drilling, many challenges follow, as these wells typically include extended reach lateral sections. These challenges include, but are not limited to: low rate of penetration (ROP), stick-slip, and poor weight on bit (WOB) transfer along the drill string. There is a strong desire in the market for a drilling tool which can address these challenges. What is needed, therefore, is an improved downhole oscillation apparatus and method.

BRIEF SUMMARY OF THE INVENTION

The present invention provides various embodiments that can address and improve upon some of the deficiencies of the prior art. One embodiment, for example provides a downhole oscillation tool for a drill string, the downhole oscillation tool including a pulse motor having a rotor with at least two helical lobes along a length of the rotor; and a stator surrounding a stator bore. The stator has at least three helical lobes along a length of the stator. The rotor is located in the stator bore and configured to nutate within the stator. The tool further includes a pulse valve assembly located downstream from the pulse motor. The pulse valve assembly preferably has a first valve plate configured to nutate with the rotor, the first valve plate including a plurality of first ports, a second valve plate located downstream from the first valve plate, the second valve plate including a plurality of second ports. Preferably, the second valve is fixedly coupled to the stator and plate abuts the first valve plate to form a sliding seal. At least one of the first ports is in fluid communication with at least one of the second ports through all positions of nutation of the first valve plate relative to the second valve plate.

According to one option, the plurality of first ports can include at least one first radially outer axial port defined in the first valve plate; and at least one first radially inner axial port defined in the first valve plate. The plurality of second ports can include at least one second radially outer axial port defined in the second valve plate; and a plurality of second radially inner axial ports defined in the second valve plate.

According to a second option, the downhole oscillation tool can include at least one of the second ports is different in flow area from the other second ports. Each second radially inner axial port can have a different flow area from other second radially inner axial ports. The second radially inner axial ports can be disposed about a central longitudinal axis of the second valve plate radially symmetrically. Alternatively, the second radially inner axial ports can be disposed about a central longitudinal axis of the second valve plate radially asymmetrically.

Also, in this embodiment, at least one first radially outer axial port can be configured to intermittently communicate with the at least one second radially outer axial port; and the at least one first radially inner axial port can be configured to intermittently communicate with each of the plurality of second radially inner axial ports. Optionally, the at least one first radially inner axial port communicates with only one of the plurality of second radially inner axial ports at a time.

According to a further option, the rotor can further include a longitudinal rotor bore defined in the rotor, and the rotor bore can extend along the entire length of the rotor. In yet another option, a drop ball assembly having a central cavity, can be coupled to the rotor so that the central cavity is in fluid communication with the rotor bore. The drop ball assembly can include a first ball seat adapted to receive a first drop ball to close the central cavity from drilling fluid flow, and a second ball seat adapted to receive a second drop ball to open the closed central cavity to drilling fluid flow. The downhole oscillation tool can further include a shock tool having a shock tool bore, the shock tool coupled to the stator so that the shock tool bore and the stator bore are in fluid communication.

In another embodiment the invention, a drill string can include a bottom hole assembly having a drill bit connected to a drilling motor, a first downhole oscillation tool having a pulse motor that includes a rotor having at least two helical lobes along a length of the rotor, and a stator surrounding a stator bore, and having at least three helical lobes along a length of the stator. The rotor is located in the stator bore and configured to nutate within the stator. The first oscillation tool can also include a pulse valve assembly located downstream from the pulse motor, the pulse valve assembly.

According to a first option, the first downhole oscillation tool can include a shock tool connected above stator. The downhole oscillation tool can be configured to generate pulses having two or more different pulse amplitudes. Alternatively the downhole oscillation tool can be configured to generate pulses at two or more different pulse frequencies.

According to a second option, the first downhole oscillation tool can include a drop ball assembly configured to activate and deactivate the first downhole oscillation tool and the drill string further include a second downhole oscillation tool spaced apart from the first downhole oscillation tool by a length of drill pipe.

In a third embodiment, the invention can provide a downhole oscillation tool that includes a positive displacement Moineau motor having a stator surrounding a stator bore. The stator bore can define at least three helical lobes extending along the length of the stator. A rotor can be located in the stator bore and have at least two helical lobes extending along a length of the rotor, so that the rotor is configured to nutate within the stator. The motor can further include a pulse valve assembly. The downhole oscillation tool can further include a shock tool having a shock tool bore, the shock tool coupled to the motor so that the shock tool bore and the stator bore are in fluid communication.

The motor is configured to generate a plurality of different pulses during a rotational cycle of the motor. According to a first option, the plurality of different pulses includes pulses having two or more different amplitudes. According to another option, the plurality of different pulses includes pulses having two or more different wavelengths.

DETAILED DESCRIPTION

Figure 1:
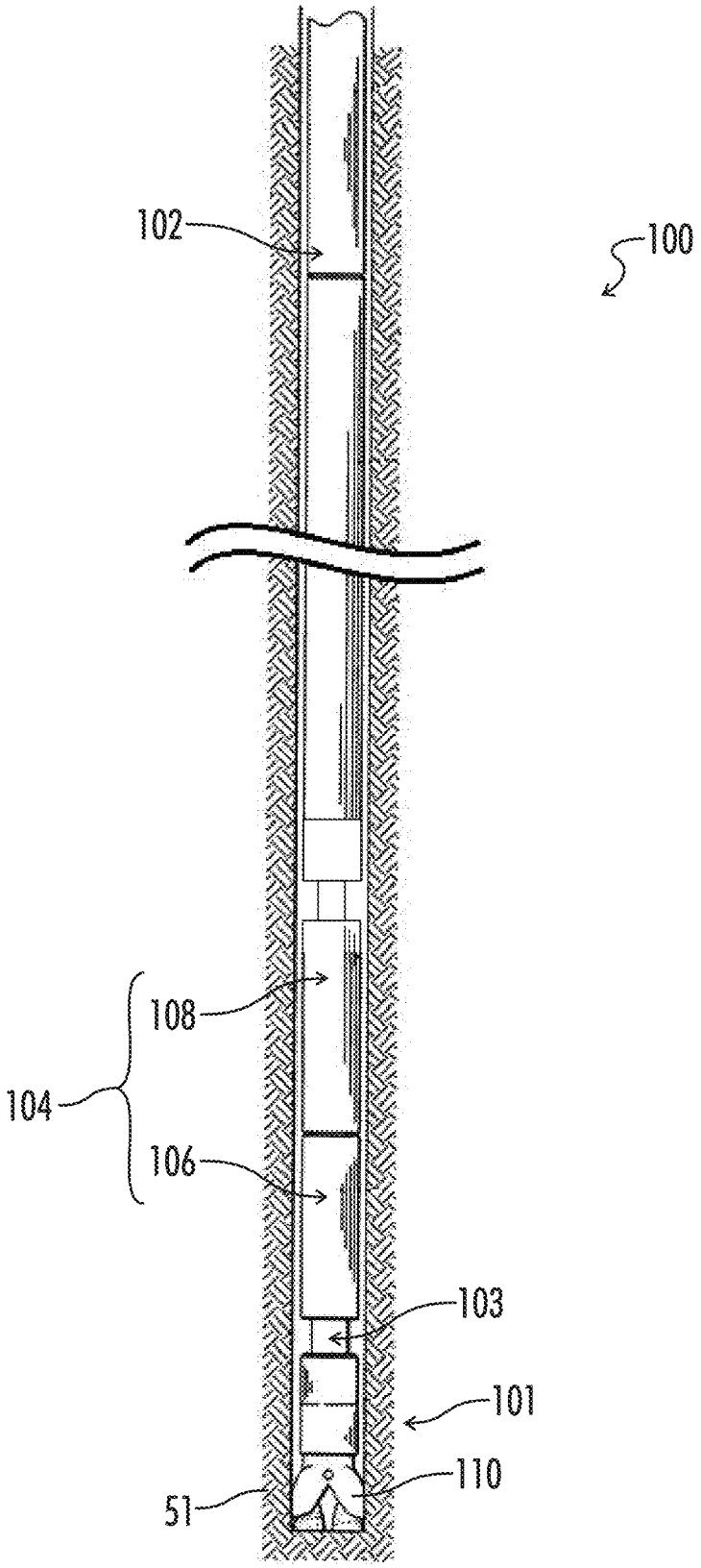
FIG. 1 is a side elevation view of a drill string including one embodiment of the downhole oscillation apparatus.

Referring to FIG. 1, a drill string 100 is shown drilling through a sub-surface formation or substrate S1. The drill string 100 can include an upper assembly including lengths of drill pipe connected to a bottom-hole assembly 101. The bottom-hole assembly 101 can include upper sections having lengths of drill pipe, stabilizers or drill collars 102, a downhole oscillation tool 104 made up of a pulse tool 106 and, optionally, a jar or shock tool 108.

The shock tool 108 can be actuated by the pulse tool 106. The pulse tool 106 can cause a series of pressure pulses. These pressure pulses can provide a percussive action in a direction substantially parallel with the axis of the drill string 100. One example of a shock tool 108 can include a shock tool bore that forms a cylinder in which a hollow piston is configured to slide. The piston outer surface can be sealed against the cylinder inner surface by seals, such as o-rings, while the hollow piston center defines a passage through which drilling mud can flow. The piston can be connected to a mandrel, which also has a hollow central passage or mandrel bore. The mandrel can extend out of the cylinder and the mandrel's outer surface also sealed against the inner surface of the cylinder. An increase in pressure of the drilling fluid in the shock tool 108 compared to the pressure of the drilling fluid outside of the shock tool can extend the mandrel from the body. At least one compression spring can be positioned to provide a resistive spring force in both directions substantially parallel with the axis of the drill string 100. The spring can be placed between a shoulder on the mandrel and a shoulder of the cylinder. The drill string 102 is preferably connected to shock tool 108 so that the inner chamber or bore of the cylinder, and passages of the mandrel and piston, are in fluid communication with the drill string bore, and drilling mud can flow from the drill string above through the mandrel bore to the drill string connected below. As such, the increased pressure of the drilling fluid in the shock tool 108 urges the mandrel outward while the spring resists forces pushing the mandrel back into the cavity of the body. A hammer effect or percussive impact action can, therefore, be effected. In many embodiments, the shock tool 108 is located upstream of the pulse tool 106 such that the fluid pressure pulses from the pulse tool act upon the piston of the shock tool.

Drill bit 110 can be connected at the bottom end of the drill string 100. The downhole oscillation tool 104 can be separated from the drill bit 110 by intermediate drill string section 103, which can include further lengths of drill pipe, drill collars, subs such as stabilizers, reamers, shock tools and hole-openers, as well as additional downhole tools. Additional downhole tools can include drilling motors for rotating the drill bit 110 and measurement-while-drilling or logging-while-drilling tools, as well as additional downhole oscillation tools. The downhole oscillation tool 104 and, optionally, other downhole subs, tools and motors, can be powered by the flow of drilling mud pumped through a throughbore that extends the length of the drill string 100.

Figure 2:
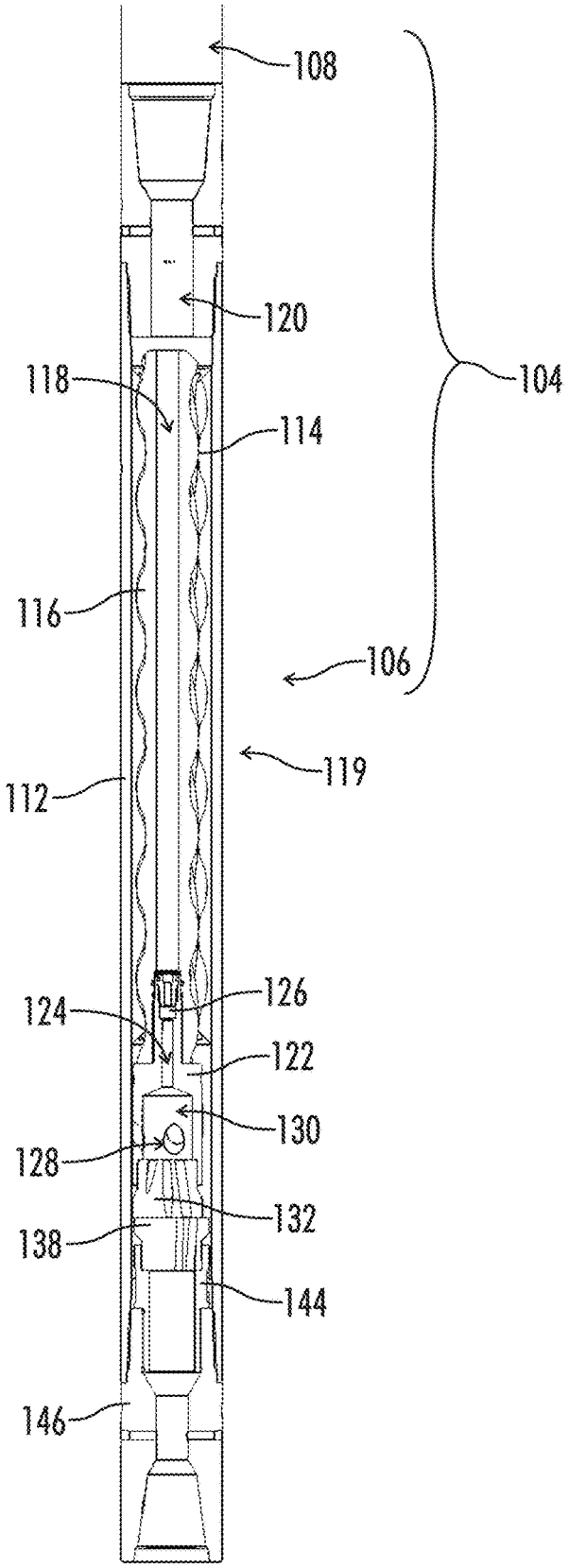
FIG. 2 is a side elevation cross-sectional view of the drill string of FIG. 1 without the drill bit.
Figure 3:
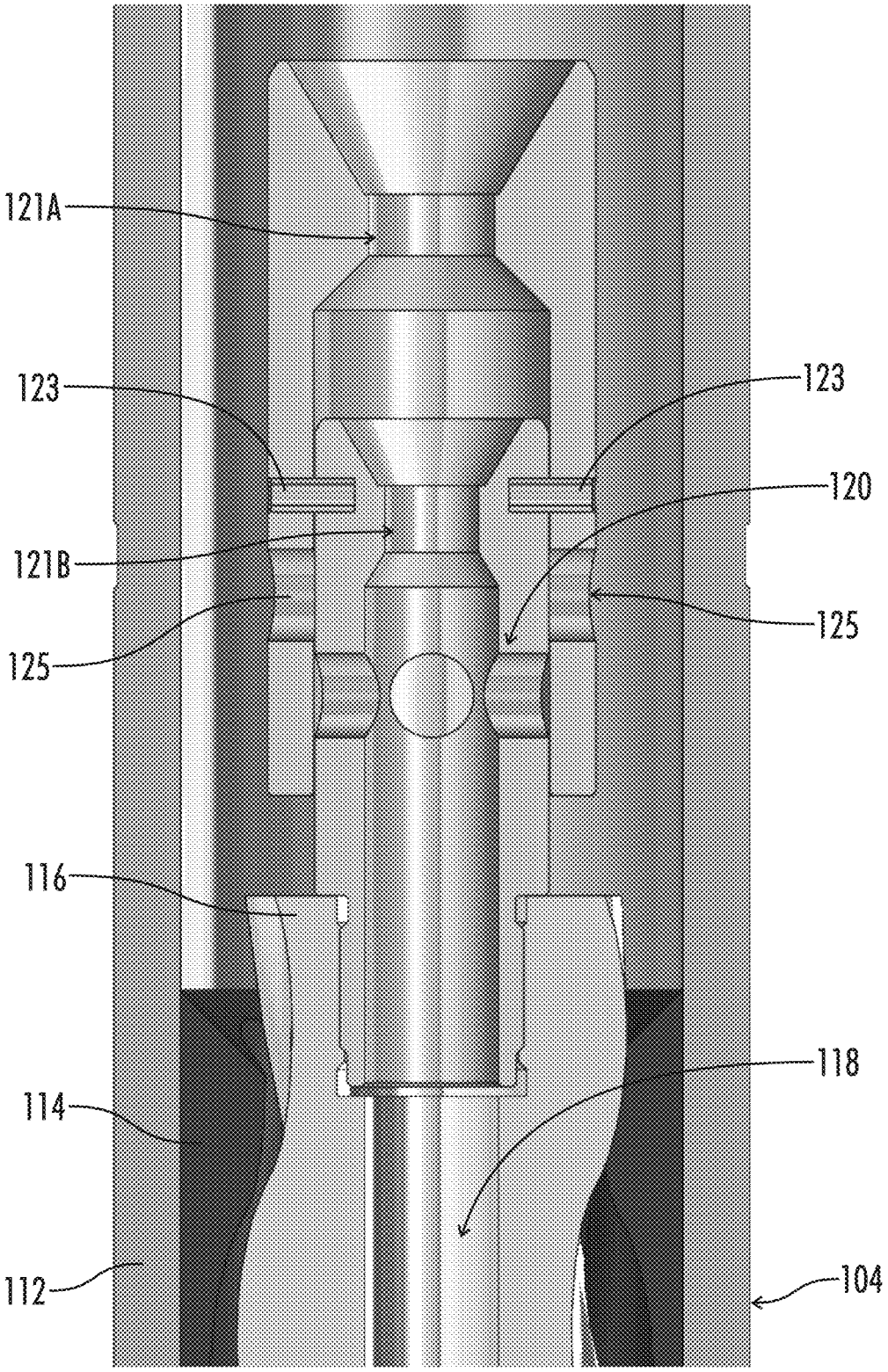
FIG. 3 is a detailed side elevation cross-sectional view of a top section of the drill string of FIG. 1 including an optional operation control mechanism.
Figure 4:
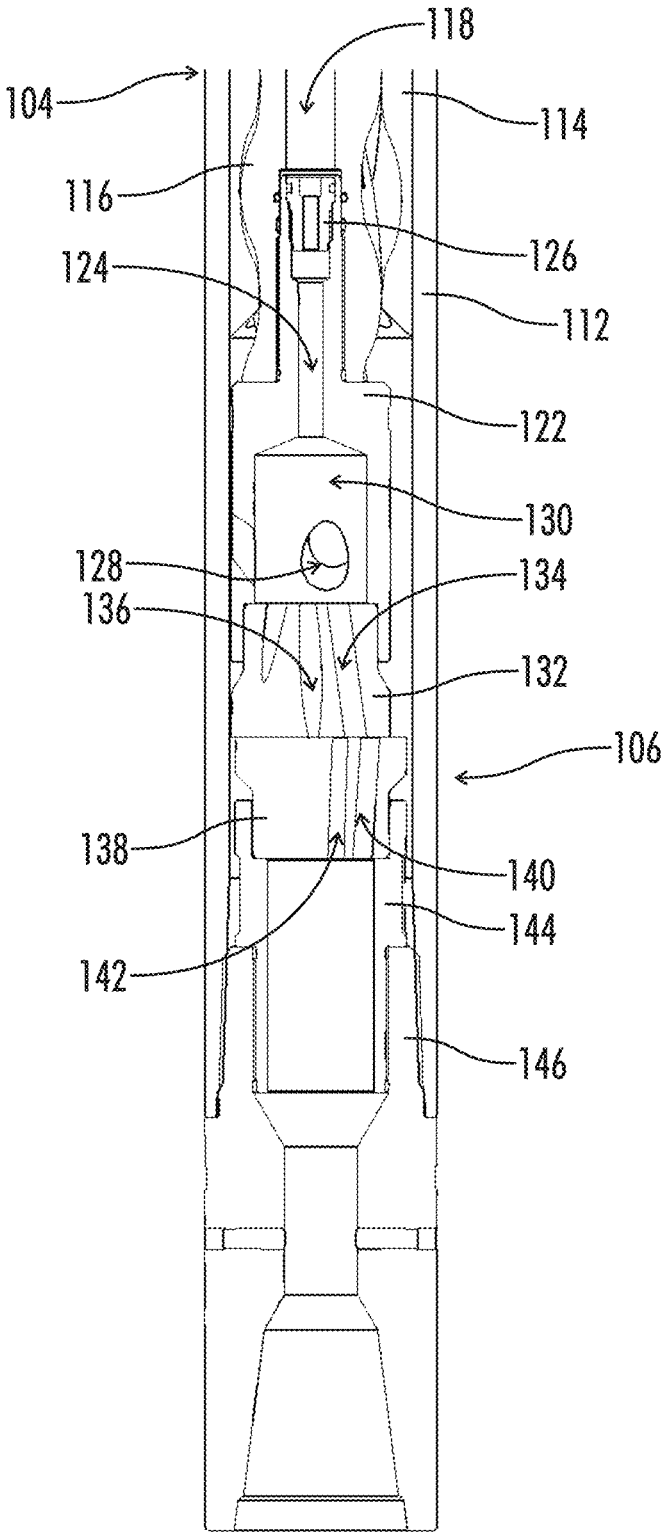
FIG. 4 is a detailed side elevation cross-sectional view of a lower section of the drill string of FIG. 1 including the downhole oscillation apparatus.
Figure 5:
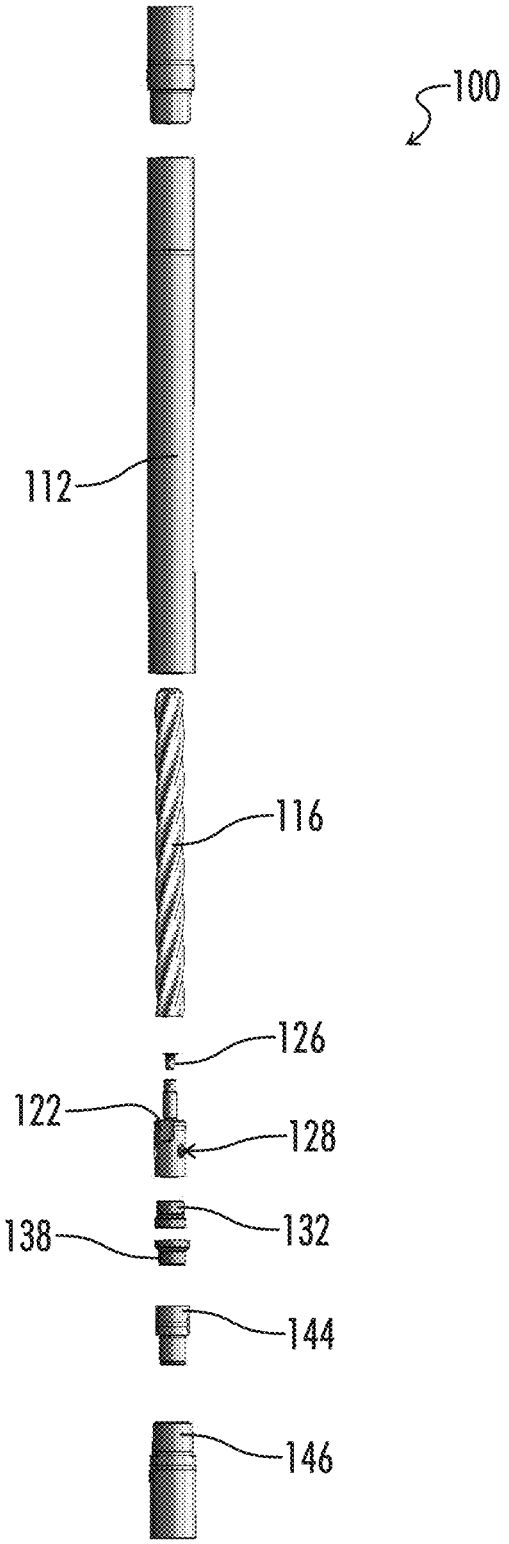
FIG. 5 is an exploded side elevation view of the drill string of FIG. 1 without the drill bit.
Figure 6:
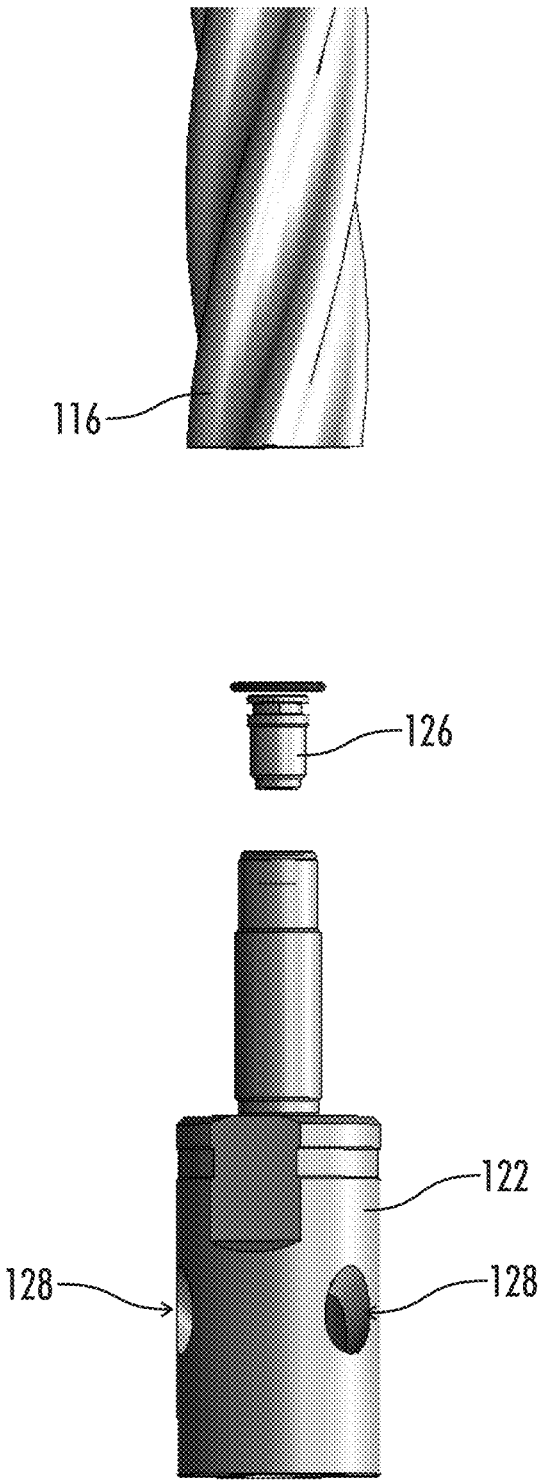
FIG. 6 is a detailed exploded side elevation view of the lower section of the drill string of FIG. 1 including a nozzle that may be placed in the bore of the rotor.
Figure 7:
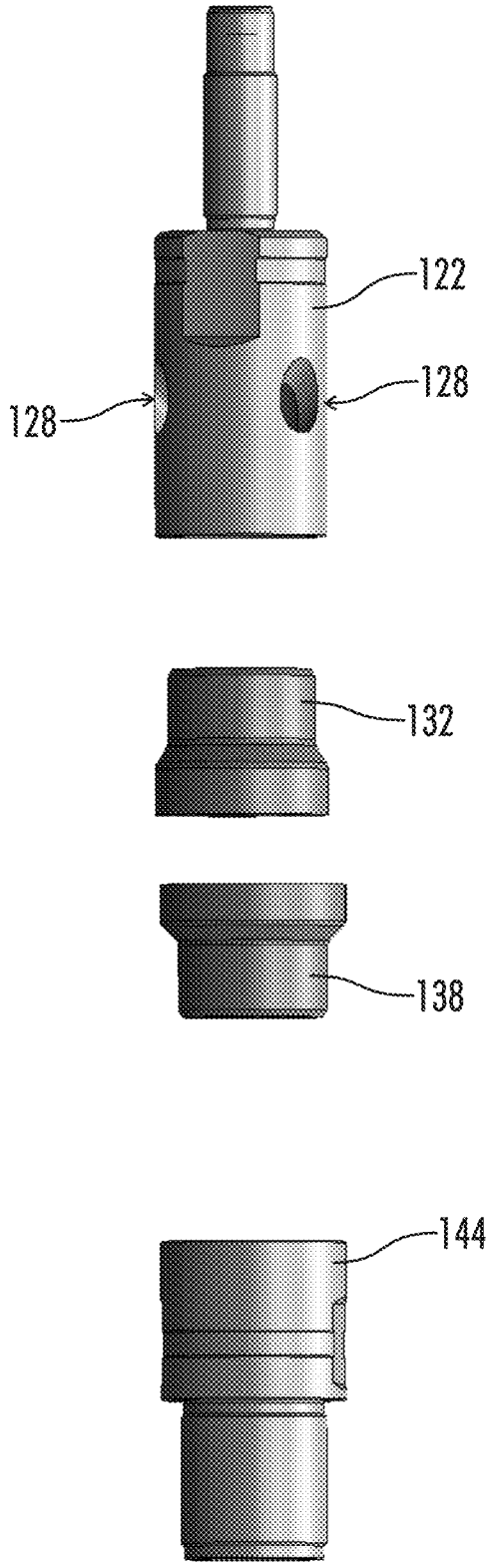
FIG. 7 is a detailed exploded side elevation view of the lower section of the drill string of FIG. 1 including components of the downhole oscillation apparatus.

FIGS. 2-4 show various components of the drill string 100 in a cross-sectional view. FIG. 2 shows drill shock tool 108 connected to a generally tubular external wall or main body 112 of power section 119 of the pulse tool 106. The pulse tool 106 can be connected to the remainder of the drill string 100 so that its throughbore generally maintains fluid communication with the bore of the remainder of the drill string 100. The connection may be any appropriate connection including, but not limited to, a threaded connection. A flow insert can be keyed into the main body 112 and flow nozzles can be screwed into the flow insert.

The pulse tool 106 can generally include a pulse motor and pulse valve located in the main body 112. Preferably, the pulse motor is a positive displacement motor operating by the Moineau principle. As such, the pulse motor preferably includes a stator 114 formed within, or formed as part of the exterior wall 112 to surround an internal throughbore. The stator's inner surface includes a number of helical lobes that extend along the length of the stator 114 and form crests and valleys in the stator wall when viewed in transverse cross-section. The pulse motor further preferably includes a rotor 116 in the throughbore of pulse motor that is capable of rotating under the influence of fluid, such as drilling mud, pumped through the drill string 100. Similar to the stator 114, the rotor 116 includes a number of helical lobes along the length of its outer surface. As generally the case with Moineau-type motor, stator 114 of pulse tool 106 has more lobes than rotor 116. However, rotors 116 according to some embodiments of the present invention preferably include two or more helical lobes and the stator 114 has at least three helical lobes. Having two or more lobes, the rotor 116 revolves in the stator 114 with a nutational motion, and its outer helical surfaces mate with the inner helical surfaces of the stator to form sliding seals that enclose respective cavities. Unlike a single lobe rotor whose rotor end exhibits a linear oscillation or side to side motion superimposed on its primary rotational motion, multiple lobe rotors preferably included in embodiments of the present invention nutate and thus exhibit secondary rotational motions in addition to the rotor's primary rotation.

Drilling fluid pumped through the bore of the drill string 100 enters the pulse tool 106 from the top sub 102. The flow of drilling fluid can then pass through a flow insert and/or flow nozzles, if included, and into the cavities formed between the stator 114 and the rotor 116. The pressure of the drilling fluid entering the cavities and the pressure difference across the sliding seals causes the rotor 116 to rotate at a defined speed in relation to the drilling fluid flow rate.

The rotor 116 can further include a rotor bore 118 defined therein. The rotor bore 118 can allow at least some of the drilling fluid to pass through a power section 119 of the drill string 100 without imparting rotation on the rotor 116. As such, the power section 119 can be completely deactivated by opening the rotor bore 118 completely. Closing the rotor bore 118 can activate the power section 119 by forcing the fluid to flow between the stator 114 and rotor 116 instead of through the rotor bore. The drill string 100 can include the rotor bore 118 being capable of any appropriate degree between fully open and fully closed to impart a desired flow rate to the power section 119 to cause a corresponding rotation of the rotor 116.

As shown in FIG. 3, the bottom joint of the top sub 102 can include a drop ball assembly 120 to mechanically open and close the fluid pathway to the rotor bore 118. Utilizing components such as a drop ball assembly 120, the rotor bore 118 can be closed or opened from the surface by an operator. Initially, the downhole oscillation tool 104 can be inactive while the drill string 100 is traveling a vertical portion of a bore to avoid damaging vibrations to components of the drill string and surface equipment. By leaving the rotor bore 118 fully open without obstructing the drop ball assembly 120, all of the drilling fluid can pass directly through the rotor bore and bypass the sealed cavities between the stator 114 and rotor 116. With the drilling fluid bypassing the sealed cavities between the stator 114 and the rotor 116, the rotor does not rotate and the downhole oscillation tool 104 remains inactive. Once activation of the downhole oscillation tool 104 is desired and/or required, a small ball that is small enough to pass through the large seating opening section 121A but too large to pass through the small seating opening section 121B can be pumped down the drill string 100 from the surface. The small ball can mechanically close the rotor bore 118 by closing the small seating opening section 121B. The resulting redirection of the drilling fluid can activate the power section 119 by forcing the drilling fluid to flow through the sealed cavities between the stator 114 and rotor 116, thereby rotating the rotor. The power section 119 can again be deactivated by fully re-opening the rotor bore 118 at a desired occasion. This re-opening can be accomplished by pumping a large ball down the drill string 100 from the surface. The large ball can be too large to pass through the large seating opening section 121A, thereby causing shear pins 123 to break when a sufficient pumping rate of the drilling fluid is provided. After the requisite force due to the drilling fluid breaks the shear pins 123, the drop ball assembly 120 shortens and allows the drilling fluid to flow around the top of the drop ball assembly and into openings 125 of the drop ball assembly to again communicate the drilling fluid with the rotor bore 118. With no drilling fluid being redirected to the sealed cavities between the stator 114 and the rotor 116, the power section 119 is again deactivated. This selective activation and deactivation permits multiple downhole oscillation tools 104 to be utilized in a drill string 100, and each of the downhole oscillation tools can be activated when appropriate based on the drilling conditions.

The ability to open and close the rotor bore 118 can be desirable in some embodiments of the drill string 100. The types of drilling tools capable of utilizing the pulsing of drilling fluid are typically not introduced into the drill string until drilling of a lateral section of the substrate S1 has begun. The primary reason for the timing of this introduction is the vibrations caused by these tools when they are run in the vertical section. These vibrations can be problematic to drilling equipment on the surface. Traditionally, once the target depth has been reached, the string must be pulled out of the hole, the oscillating tool introduced into the string, and finally the string must be tripped back into the hole. By including the ability to introduce the oscillating tool into the string while drilling the vertical section with the oscillating tool in a deactivated state, the tool can be activated once the target depth is reached from the surface. This new method may result in large cost savings associated with the time saved that would otherwise be used tripping the drill string in and out of the well. The method may also allow significant flexibility to the operator in regards to the placement of the tool in relation to the length of the lateral section. The method may even allow an operator to place multiple oscillation tools within the same drill string.

As shown in FIGS. 2 and 4, a ported connector 122 can be connected to the rotor 116. Preferably, the ported connector 122 is configured to rotate with the rotor 116. For example, the ported connector 122 can be fixedly connected to the rotor 116 by a press fit joint, a keyed joint to the rotor 116, a threaded joint, or any other appropriate mechanical connection. Drilling fluid passing through the rotor bore 118 can continue through a ported connector longitudinal bore 124. In some embodiments, a nozzle 126 can be connected to the ported connector 122. The nozzle 126 can be configured to control the amount of drilling fluid that can enter the rotor bore 118 from upstream of the nozzle. As such, the amount of drilling fluid bypassing the sealed cavities between the stator 114 and rotor 116 can be controlled. The ported connector 122 can further include at least one ported connector port 128. The ported connector port 128 can be configured to allow drilling fluid to flow radially inward from outside the ported connector 122 into a ported connector cavity 130. The drilling fluid flowing via the sealed cavities between the stator 114 and rotor 116 can, therefore, rejoin the drilling fluid flowing through the rotor bore 118 and the ported connector longitudinal bore 124.

By carefully limiting the amount of drilling fluid flow that passes through the rotor bore 118 using, for example, the nozzle 126 or a similar device, the amount of drilling fluid flow that passes through the sealed cavities between the stator 114 and rotor 116 can further be controlled. This configuration can allow an operator to control the rotational speed of the rotor 116 while still maintaining a desired pump rate of the drilling fluid. The configuration further allows an operator to control the desired pulse and, therefore, the axial oscillation frequency.

Pulse tool 106 further includes a first valve plate 132 that can be connected to the ported connector 122. Preferably, the first valve plate 132 is configured to rotate with the ported connector 122 and the rotor 116. In some embodiments, the first valve plate 132 can be press fit or keyed to the ported connector 122, so that an upper surface of the valve plate 132 forms a bottom wall of ported connector cavity 130. A lower planar surface of the first valve plate 132 abuts and preferably mates with an upper planar surface of the second valve plate 138 to form a sliding seal, so that the first valve plate 132 can slide laterally with respect to the second valve plate 138 while maintaining a fluid-tight seal. The second valve plate is also part of a pulse tool 106. While the first valve plate 132 is attached to and rotates with the rotor 116, the second valve plate 138 is preferably stationary and can be fixedly attached to the main body 112 either directly or through a series of connectors and adapters.

Figure 8:
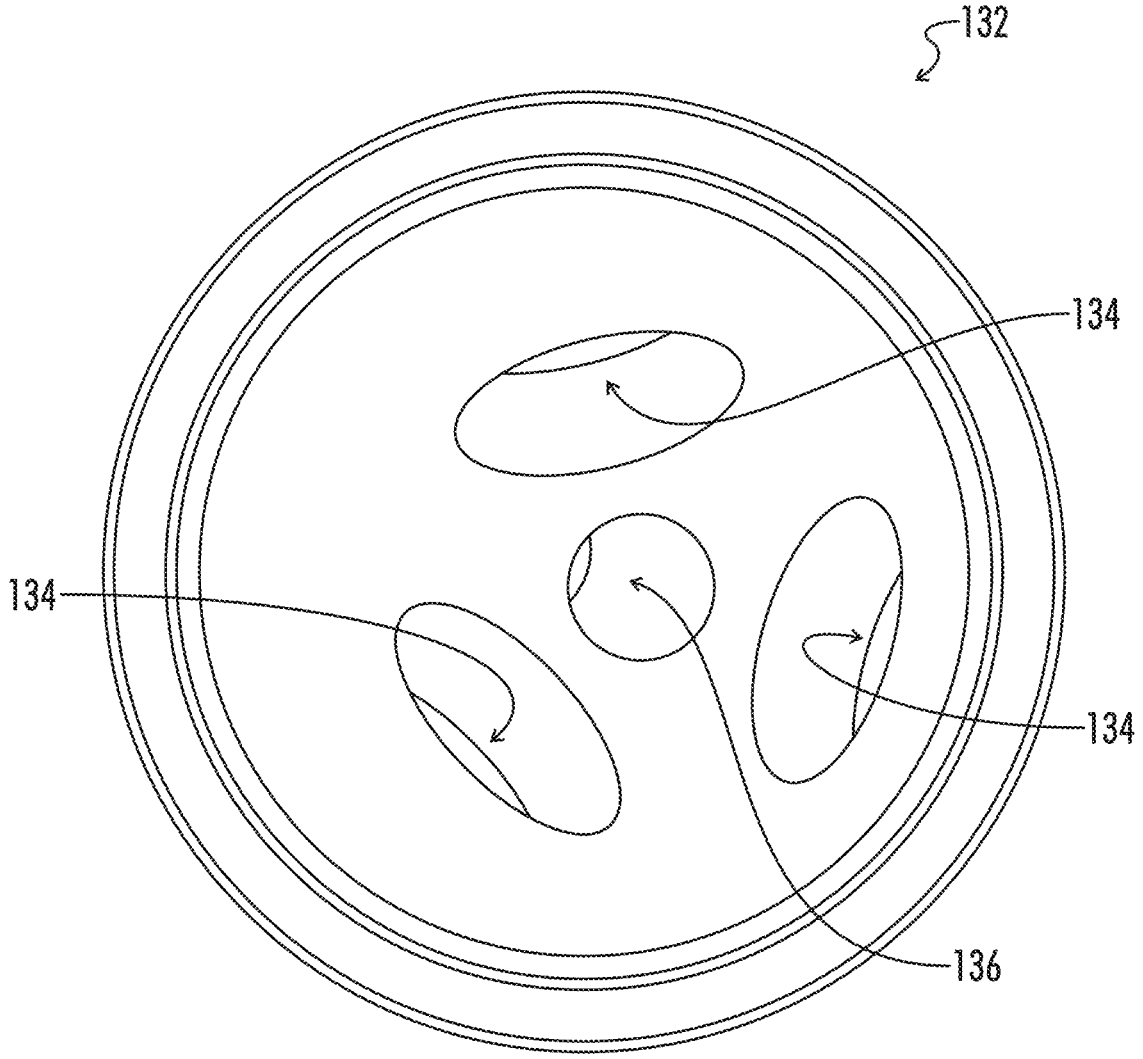
FIG. 8 is a top plan view of a first valve plate of the drill string of FIG. 1.
Figure 9:
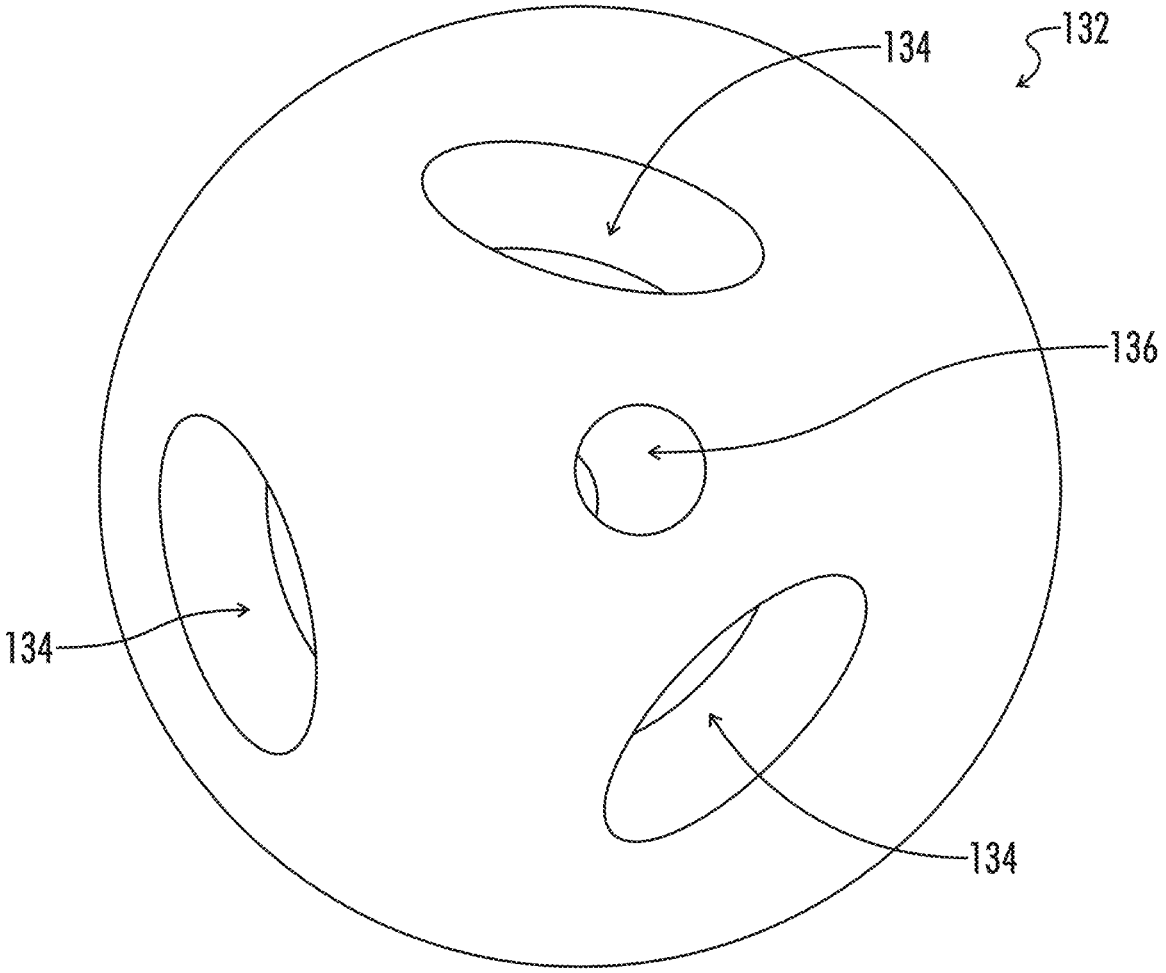
FIG. 9 is a bottom plan view of the first valve plate of FIG. 8.

As also shown in FIGS. 8 and 9, the first valve plate 132 can include multiple openings or ports that extend axially through the first valve plate 132 and permit the flow of drilling fluid that gathers in the ported connector cavity 130 to flow downwards through the drill string 100.

The first valve plate 132 can include varying arrangements of axial ports wherein ports have different sizes, shapes, radial offsets with respect the valve plate center and angular positions around the plate. For example, the first valve plate 132 can include one or more first outer axial ports 134 and one or more first inner axial ports 136 defined in the first valve plate. The second valve plate 138 can also include varying arrangements of outer axial ports 140 and inner axial ports 142 wherein ports have different sizes, shapes, radial offsets with respect the valve plate center and angular positions around the plate. The arrangement of ports in the second valve plate 138 can be different from the arrangements in the first valve plate 132.

Figure 10:
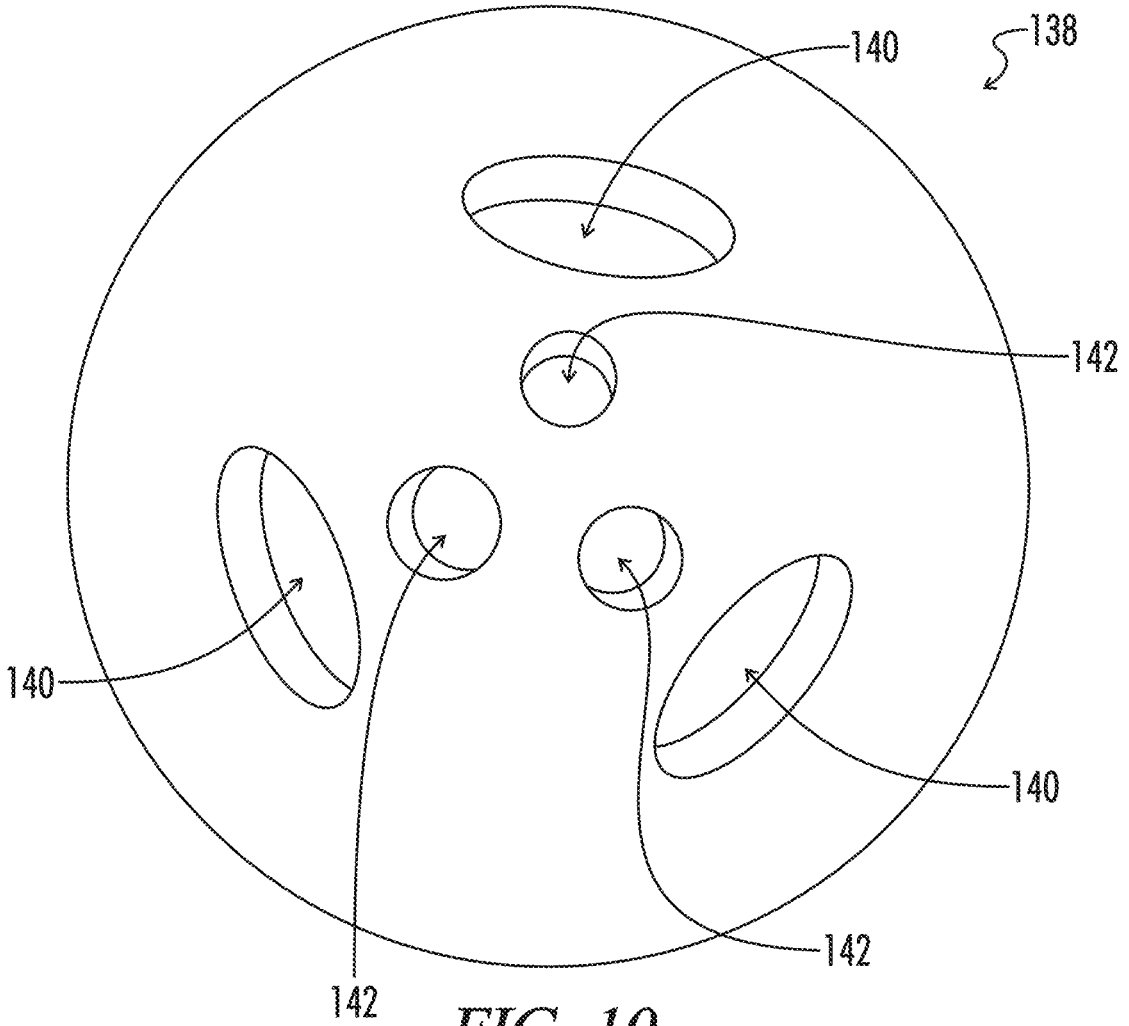
FIG. 10 is a top plan view of a second valve plate of the drill string of FIG. 1.
Figure 11:
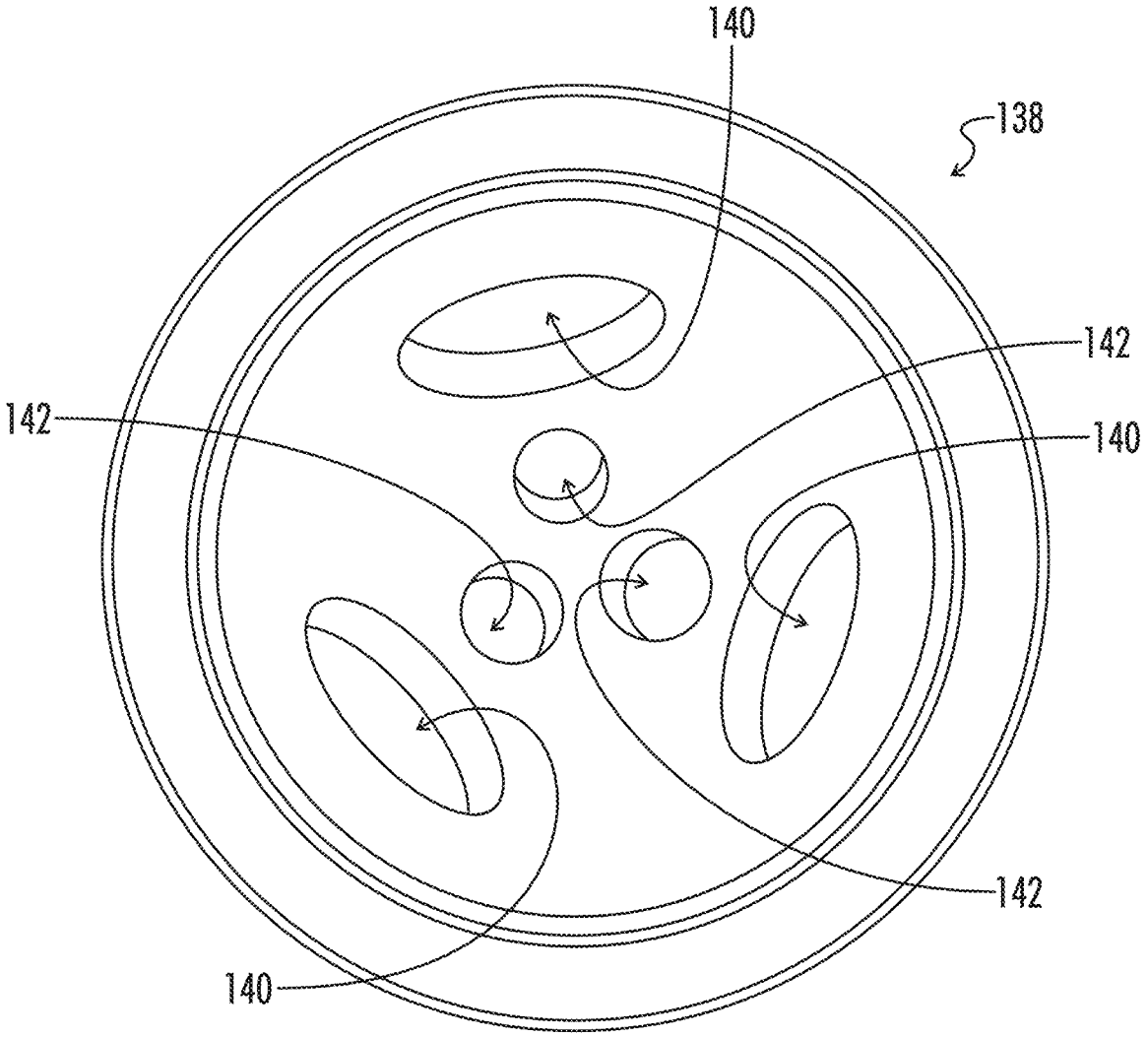
FIG. 11 is a bottom plan view of the second valve plate of FIG. 10.
Figure 12:
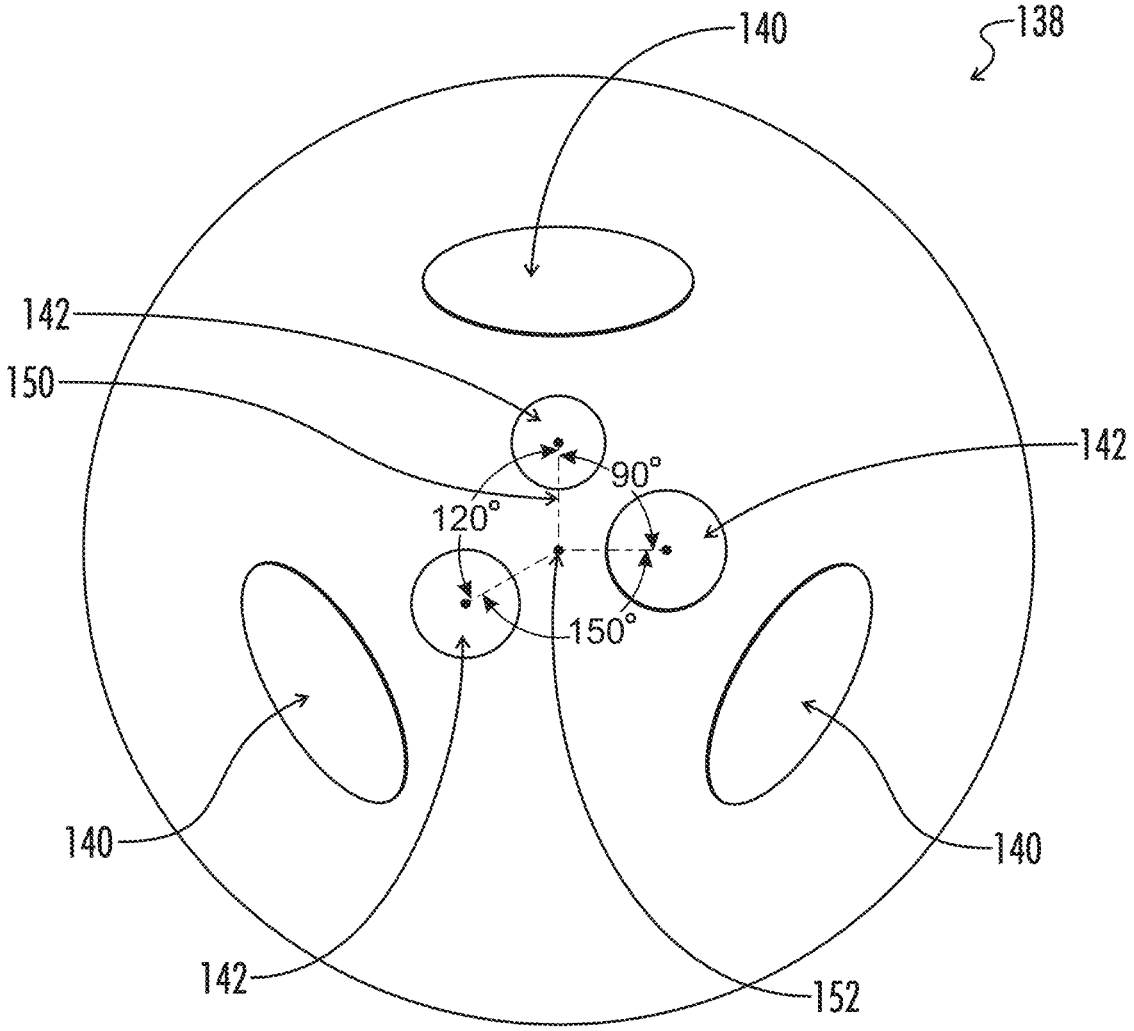
FIG. 12 is a schematic view of an opening pattern of the second valve plate of FIG. 10.
Figure 13:
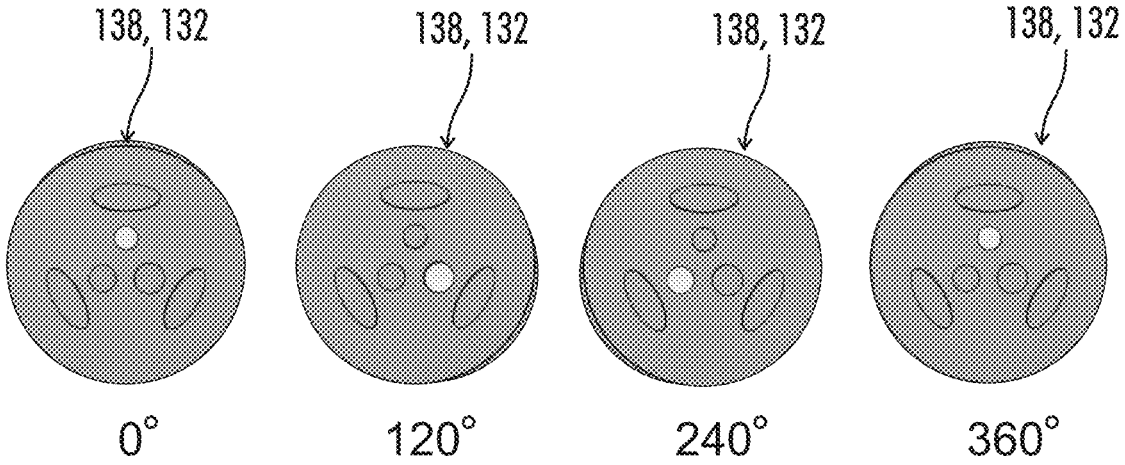
FIG. 13 is a schematic view of the first valve plate and the second valve plate as the first valve plate nutates relative to the second valve plate.

As also shown in FIGS. 10 and 11, the second valve plate 138 can include one or more second outer axial ports 140. The second outer axial ports 140 can be configured to allow drilling fluid to pass therethrough. Drilling fluid can pass through a respective first outer axial port 134 and a second outer axial port 140 when the first outer axial port at least partially overlaps with the second outer axial port during rotation of the first valve plate 132 relative to the second valve plate 138. The second valve plate 138 can further include a plurality of second inner axial ports 142. As shown schematically in FIG. 12, the second inner axial ports 142 can each be of different cross sectional flow areas or sizes and can be disposed about the longitudinal axis 152 of the second valve plate 138 at varying positions. Many embodiments include three second inner axial ports 142 of three different opening diameters. In some embodiments, the second inner axial ports 142 can be equally angularly spaced about the longitudinal axis of the second valve plate 138 as shown in FIG. 13. In other embodiments, the second inner axial ports 142 can be unequally angularly spaced, with respect to angular reference line 150, about the longitudinal axis 152 of the second valve plate 138 as shown in FIG. 12. Stated another way, each of the differently sized second inner axial ports 142 can be arranged radially asymmetrically such that the circumferential distance between respective adjacent openings is different from the circumferential distance between other respective adjacent openings. Outer axial ports 134, 140 as well as first inner axial ports 136 can exhibit similar variations in sizes, shapes and positions as the second inner axial ports 142.

Because the first inner axial ports 134 defined in the first valve plate 132 can be angled relative to the longitudinal axis of the first valve plate, the first inner axial ports 134 can be configured to communicate with only one of the plurality of second inner axial ports 142 defined in the second valve plate 138 at a time. In such cases, as the first valve plate 132 nutates relative to the second valve plate 138, the first inner axial ports 134 successively communicates with each of the plurality of second inner axial ports 142. Generally, as the first valve plate 132 slidably rotates on the second valve plate 138, drilling fluid flows through the first and second valve plates 132, 138 at varying pressures and flow rates as the overlap between the first axial ports and second axial ports—and thus the flow area available to the drilling fluid—varies. The fixed flow rate forced through a variable cross-sectional area forms pressure pulses upstream and downstream of the valve plates. This cycle of communicating the first inner axial ports 134 with each of the plurality of second inner axial ports 142 is shown schematically in FIG. 13.

The combination of the intermittent communication between the first outer axial ports 134 with the second outer axial ports 140 and the intermittent communication between the first inner axial ports 136 with each of the plurality of the second inner axial ports 142 can allow for drilling fluid to pass through both the first valve plate 132 and the second valve plate 138 at all times. Stated another way, the ports or openings 134, 136 in the first valve plate 132 and the ports or openings 140, 142 in the second valve plate 138 can be defined such that at least one opening of the first valve plate can at least partially overlap with at least one opening of the second valve plate no matter what rotational position the first valve plate is in relative to the second valve plate.

The second valve plate 138 can be connected to an adapter 144. In many embodiments, the second valve plate 138 can be press fit or keyed to the adapter 144. The adapter 144 can then be connected to a joint coupling, or bottom sub 146. In some embodiments, the adapter 144 can be press fit or keyed to the joint coupling 146. The joint coupling 146 can be connected to the tubular main body 112 of the power section 119 and the pulse section 106. The connection can be any appropriate connection including, but not limited to, a threaded connection.

Figure 14:
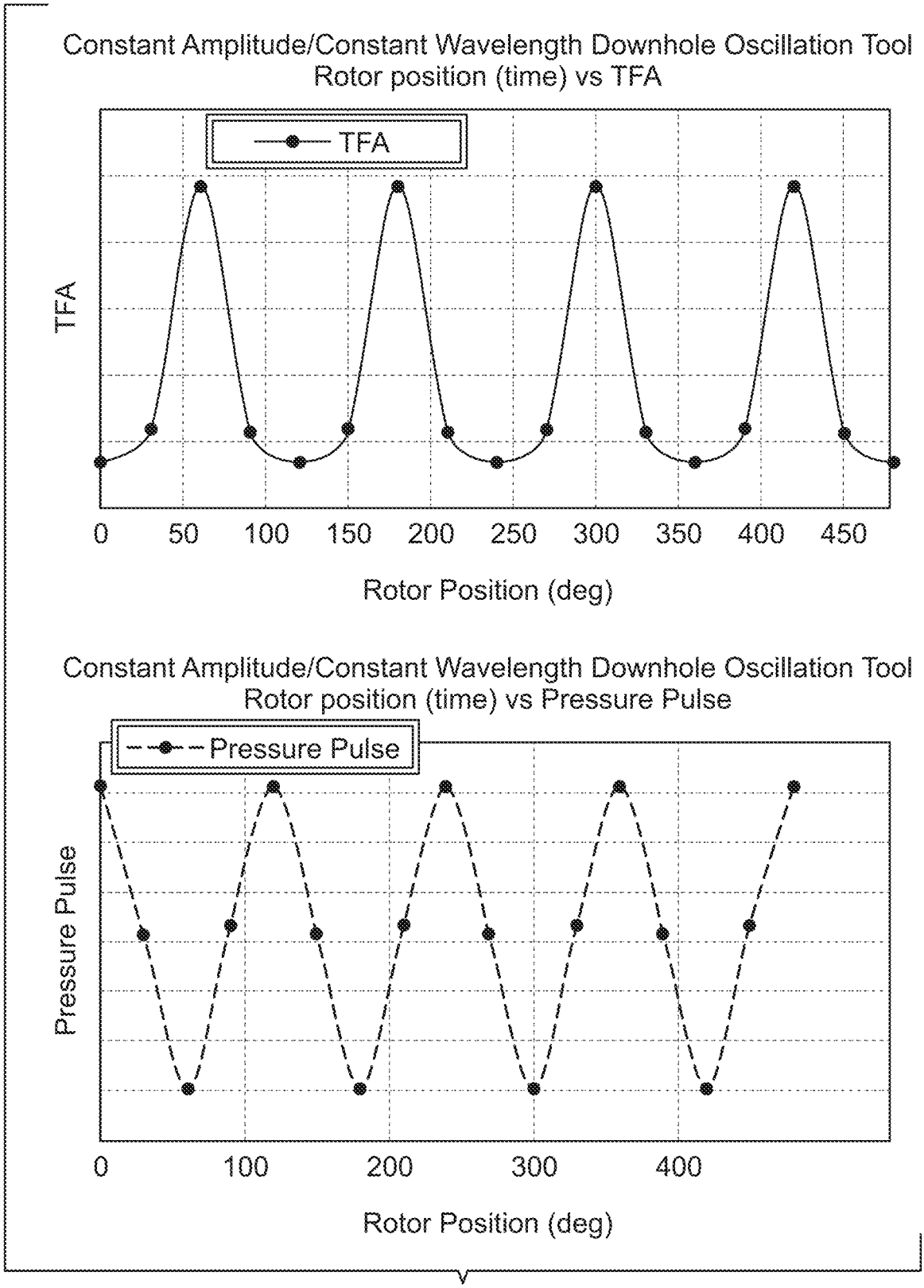
FIG. 14 is a set of graphs with regard to a condition of constant amplitude and constant wavelength of the downhole oscillation tool. The first graph illustrates the rotor position of the two valve plates of FIG. 13 and the corresponding total flow area through the two valve plates as the first valve plate nutates relative to the second valve plate. The second graph illustrates the rotor position of the two valve plates of FIG. 13 and the corresponding pressure pulse in the downhole oscillation tool.
Figure 15:
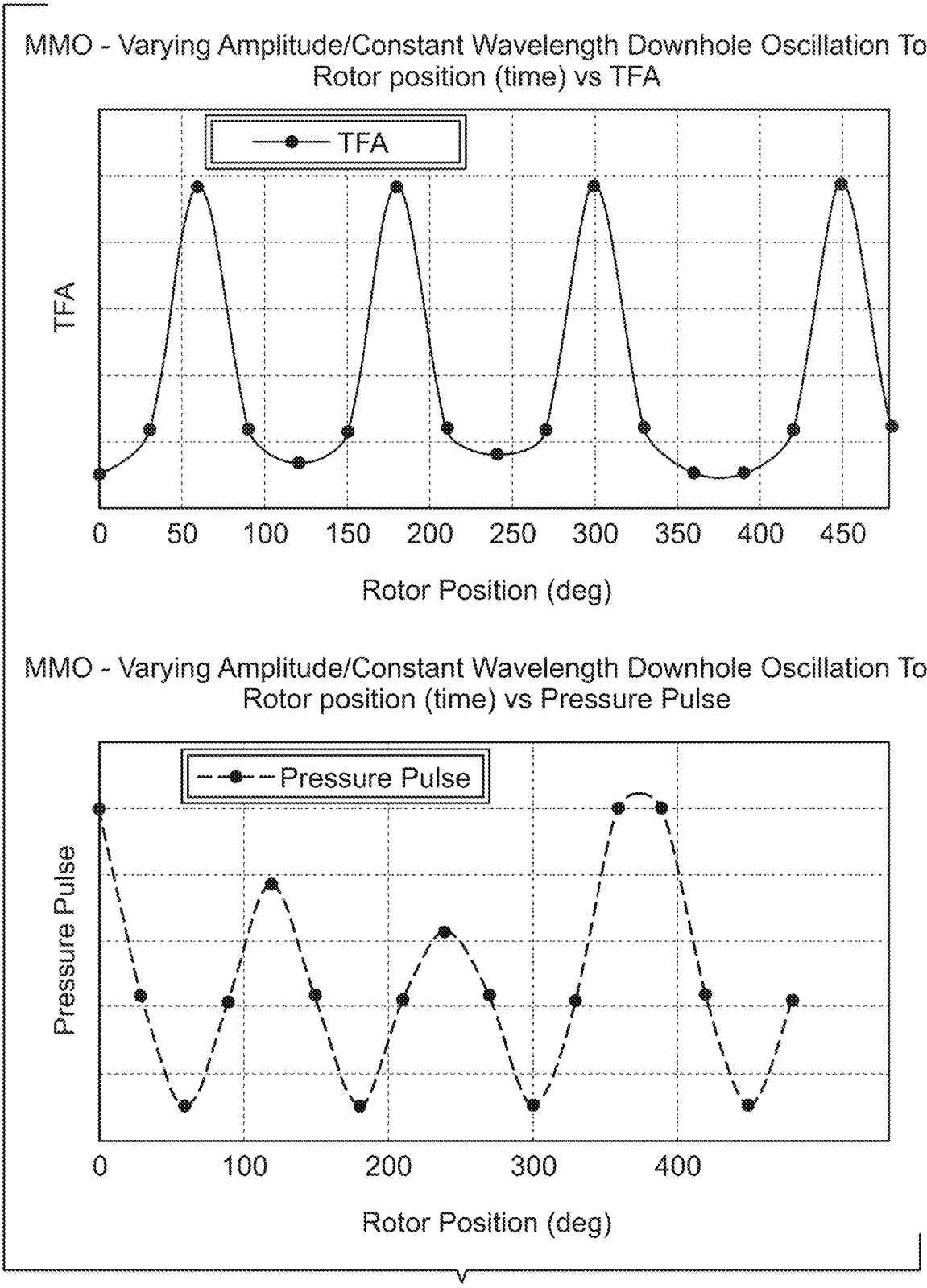
FIG. 15 is a set of graphs similar to those shown in FIG. 14, but in a mixed mode operation of the downhole oscillation tool with a varying amplitude and constant wavelength of the downhole oscillation tool.
Figure 16:
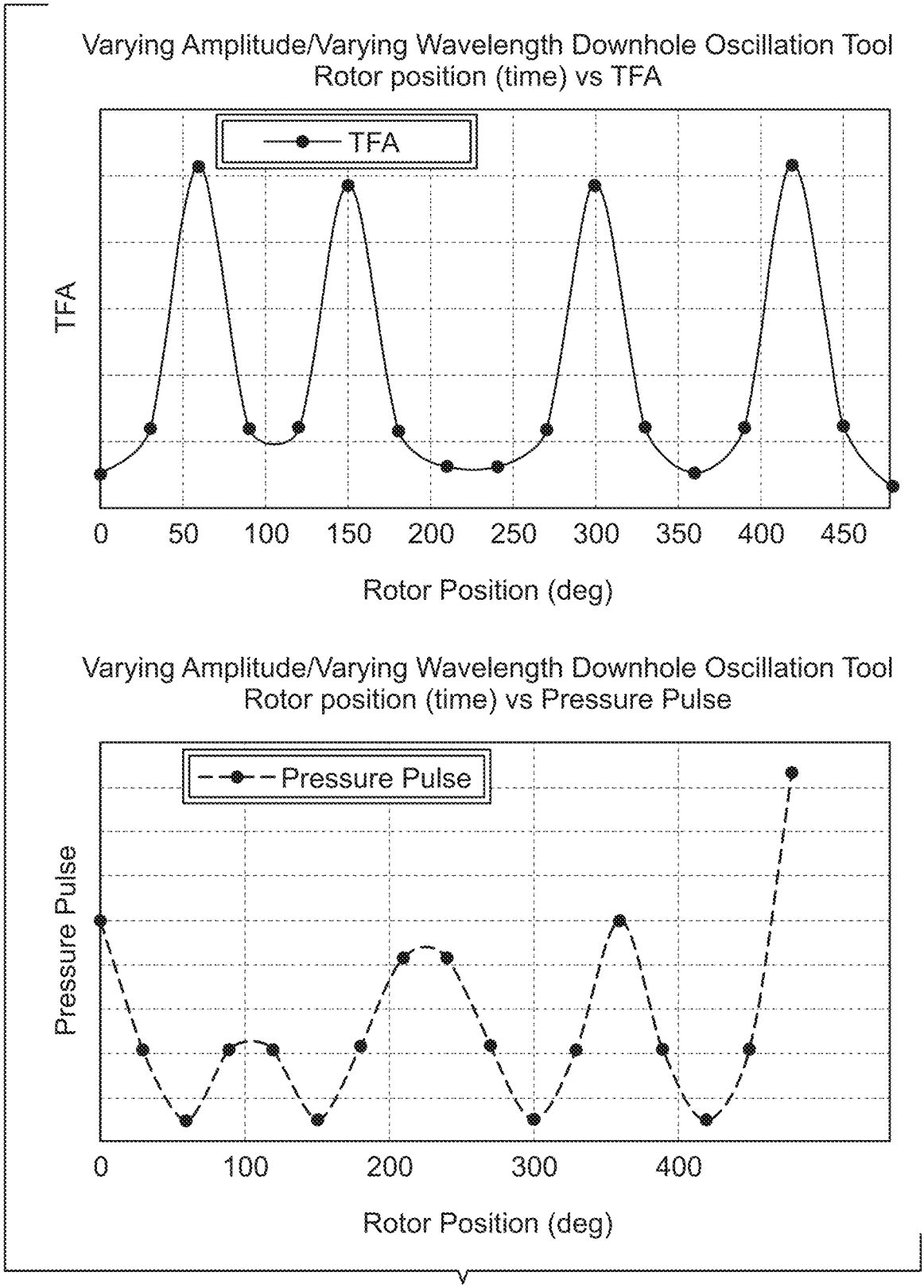
FIG. 16 is a set of graphs similar to those shown in FIG. 14, but with regard to a condition of varying amplitude and varying wavelength of the downhole oscillation tool.

By designing the valve plates 132, 138 with a valve geometry that produces multiple pressure pulses of the drilling fluid per revolution of the rotor 116, the minimum total flow area (TFA) of each pulse can be designed to have different values. Each of these distinct minimum TFA values can produce a different pulse amplitude. These different pulse amplitudes can, in turn, produce different oscillation amplitudes once the pulses act upon an excitation tool containing pistons and springs. Relationships of TFA vs. rotor position and pulse amplitude vs. rotor position are shown in FIGS. 14-16.

Figure 17:
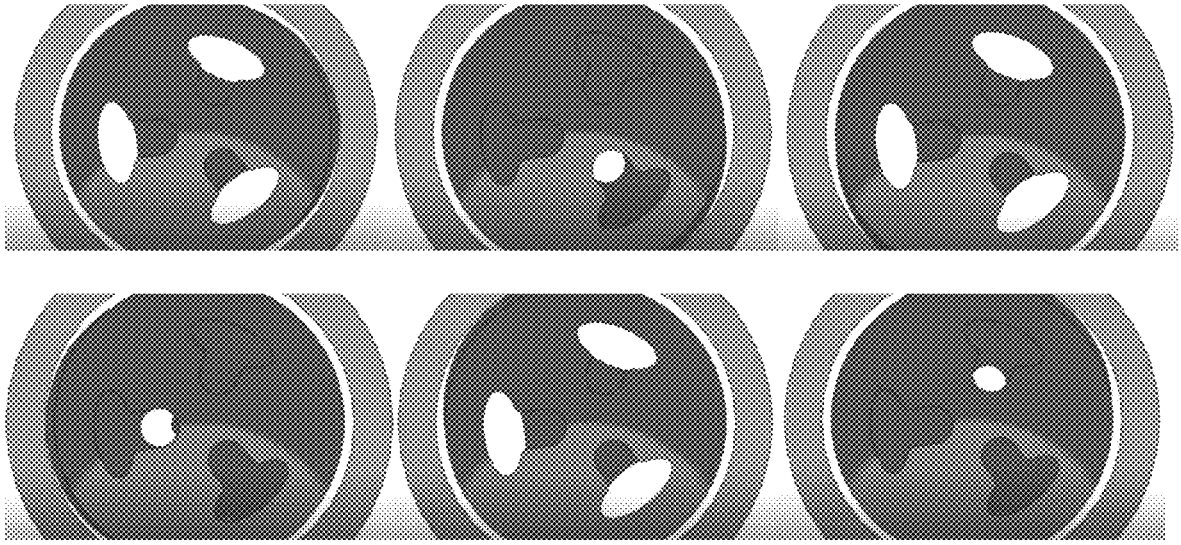
FIG. 17 is a series of schematic views of an alternative embodiment of a first valve plate and a second valve plate as the first valve plate nutates relative to the second valve plate.

As schematically illustrated in FIG. 17, an alternative embodiment of the drill string 100 including the first valve plate 132 can have an alternative second valve plate 148. The alternative second valve plate 148 can include second outer axial ports 140 that are each merged with a respective one of the second radially inward openings. In some embodiments, each of the openings can resemble a T or three lobes merged as one opening. Of course, the ports 140 may be any appropriate shape, and each port may be the same as or different from the other respective ports. The valve plates 132, 148 can function substantially similar to the valve plates 132, 138 discussed above. The design shown in FIG. 17 may follow or represent a hypocycloid.

With many embodiments disclosed herein, multiple oscillation amplitudes can be produced during operation using one valve assembly (first valve plate 132 and second valve plate 138). Many further embodiments may produce multiple oscillation amplitudes during operation using only the one valve assembly. The power section 119 can convert the hydraulic energy introduced into the drilling string into mechanical rotational energy. The rotational speed of the power section 119 can be strictly a function of the volumetric flow rate pump through the power section. The power section 119 then can drive a valve which can change the TFA of the flow through the rotor bore 118. More particularly, the power section 119 can drive the first valve plate 132 rotationally relative to the second valve plate 138. The geometry of the openings 136, 142 in the valve plates 132, 138 can allow production of different minimum and maximum TFA values during one rotational cycle of the power section 119 as shown in FIG. 16. These configurations can produce mixed-mode oscillations (MMO), which can be beneficial with regard to the drill string mechanics. This configuration can further allow the downhole oscillation tools 104 to produce oscillations with varying wavelengths. The varying wavelengths can allow the downhole oscillation tools 104 to produce multiple sets of oscillation frequencies using only one power section 119 and one valve assembly 132, 138. The likelihood of vibrations generated by these multiple oscillations matching a natural frequency of the drill string 100 can be greatly reduced when compared to previous downhole oscillation tool designs. It is considered good drilling practice to avoid resonance and the harmful effects that can accompany it during drilling. The disclosed configuration can further allow for reduction of the oscillation frequency of the drill string 100 while maintaining the desired pump rate of the drilling fluid.

A further potential benefit of the configuration of the current disclosure can be decreasing rotational speed of the power section 119 while still producing a desired pulse frequency. Typically, the frequency of the tools used with the drill string 100 is a function only of the rotational speed of the rotor 116. If a higher frequency is desired in the typical drill string 100, a higher rotational speed is required. With the ability to produce multiple pulses with only one revolution of the rotor 116, however, the rotational speed of the rotor may not necessarily be required. By decreasing the required rotational speed of the rotor 116, the rotating components of the drill string 100 can see less wear and can have a longer functional life. The reliability and long-term performance of the drill string 100, therefore, can be greatly increased. Further, the oscillation can be able to be optimized for a particular drill string or well profile.

It is important to note that multiple configurations of the valve plates 132, 138 can be considered to be within the scope of the current disclosure. The valve configurations can be designed such that a given valve configuration follows the hypocycloid path of the rotor 116 in the power section 119.

This written description uses examples to disclose the invention and also to enable any person skilled in the art to practice the invention, including making and using any devices or systems. The patentable scope of the invention is defined by the claims, and can include other examples that occur to those skilled in the art. Such other examples are intended to be within the scope of the claims if they have structural elements that do not differ from the literal language of the claims or if they include equivalent structural elements with insubstantial differences from the literal language of the claims.

Although embodiments of the disclosure have been described using specific terms, such description is for illustrative purposes only. The words used are words of description rather than limitation. It is to be understood that changes and variations may be made by those of ordinary skill in the art without departing from the spirit or the scope of the present disclosure. In addition, it should be understood that aspects of the various embodiments may be interchanged in whole or in part. While specific uses for the subject matter of the disclosure have been exemplified, other uses are contemplated. Therefore, the spirit and scope of the claims should not be limited to the description of the versions contained herein.

What is claimed is:

1. A downhole oscillation tool for a drill string, the downhole oscillation tool comprising:

a pulse motor;

a rotor having at least two helical lobes along a length of the rotor; and a stator surrounding a stator bore, the stator having at least three helical lobes along a length of the stator, wherein the rotor is located in the stator bore and configured to nutate within the stator;

a pulse valve assembly located downstream from the pulse motor, the pulse valve assembly including:

a first valve plate configured to nutate with the rotor, the first valve plate including a plurality of first ports;

a second valve plate located downstream from the first valve plate, the second valve plate including a plurality of second ports, wherein the second valve plate is fixedly coupled to the stator and abuts the first valve plate to form a sliding seal, and wherein at least one of the first ports is in fluid communication with at least one of the second ports through all positions of nutation of the first valve plate relative to the second valve plate; and wherein:

the plurality of first ports includes at least one first radially outer axial port defined in the first valve plate; and at least one first radially inner axial port defined in the first valve plate; and the plurality of second ports includes at least one second radially outer axial port defined in the second valve plate; and a plurality of second radially inner axial ports defined in the second valve plate, wherein each of the first and second valve plates has a central axis and each of the first and second axial ports has a central axis, and wherein each of the radially outer axial ports has a central axis that is radially farther from the central axis of its respective valve plate than the central axis of each of the radially inner axial ports on the same valve plate.

2. The downhole oscillation tool of claim 1, wherein:

at least one of the second ports is different in flow area from the other second ports.

3. The downhole oscillation tool of claim 1, wherein:

each second radially inner axial port is different in flow area from other second radially inner axial ports.

4. The downhole oscillation tool of claim 1, wherein:

the second radially inner axial ports are disposed about a central longitudinal axis of the second valve plate radially symmetrically.

5. The downhole oscillation tool of claim 1, wherein:

the second radially inner axial ports are disposed about a central longitudinal axis of the second valve plate radially asymmetrically.

6. The downhole oscillation tool of claim 1, wherein:

the at least one first radially outer axial port is configured to intermittently communicate with the at least one second radially outer axial port; and the at least one first radially inner axial port is configured to intermittently communicate with each of the plurality of second radially inner axial ports.

7. The downhole oscillation tool of claim 1, wherein:

the at least one first radially inner axial port communicates with only one of the plurality of second radially inner axial ports at a time.

8. The downhole oscillation tool of claim 1, wherein:

the rotor further includes a longitudinal rotor bore defined in the rotor, the rotor bore extending along the entire length of the rotor.

9. The downhole oscillation tool of claim 8, further comprising:

a drop ball assembly having a central cavity, wherein the drop ball assembly is coupled to the rotor so that the central cavity is in fluid communication with the rotor bore the drop ball assembly includes a first ball seat adapted to receive a first drop ball to close the central cavity from drilling fluid flow, and a second ball seat adapted to receive a second drop ball to open the closed central cavity to drilling fluid flow.

10. The downhole oscillation tool of claim 1 further comprising:

a shock tool having a shock tool bore, the shock tool coupled to the stator so that the shock tool bore and the stator bore are in fluid communication.

11. A downhole oscillation tool comprising:

a positive displacement Moineau motor that includes;

a stator surrounding a stator bore, the stator bore defining at least three helical lobes extending along the length of the stator, a rotor located in the stator bore, the rotor having at least two helical lobes extending along a length of the rotor and configured to nutate within the stator; and a pulse valve assembly located downstream from the motor, the pulse valve assembly having a first valve plate configured to nutate with the rotor, the first valve plate including a plurality of first ports, the pulse valve assembly also having a second valve plate located downstream from the first valve plate, the second valve plate including a plurality of second ports, wherein the second valve plate is fixedly coupled to the stator and abuts the first valve plate to form a sliding seal, wherein the plurality of first ports includes at least one first radially outer port and at least one first radially inner port defined in the first valve plate, and wherein the plurality of second ports includes at least one second radially outer port and at least one second radially inner port defined in the second valve plate, wherein each of the first and second valve plates has a central axis and each of the first and second ports has a central axis, and wherein each of the radially outer ports has a central axis that is radially farther from the central axis of its respective valve plate than the central axis of each of the radially inner ports on the same valve plate;

shock tool having a shock tool bore, the shock tool coupled to the motor so that the shock tool bore and the stator bore are in fluid communication;

wherein the motor is configured to generate a plurality of different pulses during a rotational cycle.

12. The downhole tool of claim 11 wherein the plurality of different pulses includes pulses having two or more different amplitudes.

13. The downhole tool of claim 11 wherein the plurality of different pulses includes pulses having two or more different wavelengths.

* * * * *